US006547469B2

(12) United States Patent
Vito

(10) Patent No.: US 6,547,469 B2
(45) **Date of Patent: *Apr. 15, 2003**

(54) SPRAY SQUEEGEE HAVING AUTOMATIC RECIPIENT SURFACE WETTING MECHANISM WITH EXTENTION AND REMOTE TRIGGERING SYSTEM

(76) Inventor: John Vito, 519 School Rd., Clarks Summit, PA (US) 18411

( * ) Notice: Subject to any disclaimer, the term of this patent is extended or adjusted under 35 U.S.C. 154(b) by 0 days.

This patent is subject to a terminal disclaimer.

(21) Appl. No.: 09/886,713

(22) Filed: Jun. 21, 2001

(65) Prior Publication Data

US 2002/0071711 A1 Jun. 13, 2002

Related U.S. Application Data

(63) Continuation-in-part of application No. 09/737,023, filed on Dec. 11, 2000.

(51) Int. Cl.[7] ..... A47L 1/08; A47L 1/05

(52) U.S. Cl. ..... 401/138; 401/139; 401/140; 401/146; 401/263; 401/266; 401/267

(58) Field of Search ..... 401/138, 139, 401/146, 140, 263, 266, 267; 239/532; 222/174

(56) References Cited

U.S. PATENT DOCUMENTS

| | | | | |
|---|---|---|---|---|
| 622,809 | A | 4/1899 | Keyser | |
| 1,783,506 | A | 12/1930 | Homiller | 401/139 |
| 3,377,123 | A | 4/1968 | Leeson | |
| 3,658,432 | A | 4/1972 | Lanusse | |
| 4,023,711 | A | 5/1977 | Sena | |
| 4,089,440 | A | 5/1978 | Lee | |
| 4,457,472 | A | 7/1984 | Gerberth, Jr. | |
| 4,776,716 | A | 10/1988 | Huang | |
| 5,165,811 | A | 11/1992 | MacLeod | |
| 5,186,392 | A | 2/1993 | Pleshek | |
| 5,364,198 | A | 11/1994 | Skenderi | |
| 6,010,267 | A | 1/2000 | Vito | 401/138 |

*Primary Examiner*—David J. Walczak
*Assistant Examiner*—Kathleen J. Prunner
(74) *Attorney, Agent, or Firm*—Kenneth P. Glynn, Esq.

(57) ABSTRACT

The present invention is a spray squeegee having automatic recipient surface wetting mechanism with extension and remote triggering system, which includes a squeegee section having an enclosed container for holding liquid, a sprayer head, which is in connection with the squeegee section, and a surface extending in a lengthwise direction. The enclosed container has a threaded neck. The sprayer head has a threaded cap adapted for engaging the threaded neck, as well as a dispensing means for dispensing the liquid. There is a squeegee blade and at least one wiping mechanism. One wiping means includes a wiping support that has a plurality of nozzles for wetting the wiping mechanism and is located on a side opposite the blade. Another wiping means, which may be on the blade side or the first wiping mechanism side, is tiltable and includes a clamp for holding a wiping material.

15 Claims, 2 Drawing Sheets

SPRAY SQUEEGEE HAVING AUTOMATIC RECIPIENT SURFACE WETTING MECHANISM WITH EXTENTION AND REMOTE TRIGGERING SYSTEM

REFERENCES TO RELATED APPLICATION

This application is a continuation-in-part of copending application Ser. No. 09/737,023, filed on Dec. 11, 2000, entitled Squeegee with Squeegee Handle and Remote Spraying Device, by the same inventor herein.

BACKGROUND OF THE INVENTION

1. Field of the Invention

The present invention relates to the field of wiping devices and, in particular, to a novel squeegee with a handle having an automatic recipient surface wetting mechanism and at least one other wiping means. More particularly, it relates to those wiping devices having various sized, shaped, and operational pole extended handles.

2. Information Disclosure Statement

There are many utility patents and design patents relating to wiping devices. The following is representative of the art:

U.S. Pat. No. 6,010,267 to John Vito, the same inventor herein, which issued on Jan. 4, 2000, discloses an extended squeegee and fluid delivery system for cleaning in places that are of high elevation. A squeegee is used in connection with an extended handle. The spray system has a pump that delivers a cleaning agent through a conduit in connection with the squeegee. There is a trigger in connection with the spray bottle and near the end of the handle where the user is holding the handle. The user may then deliver cleaning agent out the nozzle by squeezing on a trigger or pull cord in connection with the handle. The handle of the squeegee may be made hollow in order to deliver the cleaning agent from the source of the agent to the nozzle in connection with the squeegee. The device is directed to telescoping poles and having a pressure inducing means, which causes a drop in pneumatic pressure.

U.S. Pat. No. 5,364,198 to Skenderi describes and illustrates a self contained window cleaning implement, which has and elongated handle member, a squeegee member located on one end of the elongated handle member, a spray nozzle for dispensing a spray, a reservoir for holding a supply of cleaning fluid, a tube extending from the reservoir to the spray nozzle for transferring the cleaning fluid from the reservoir to the spray nozzle, and a manually actuable pump apparatus for forcing the cleaning fluid from the reservoir, through the tube, and to the spray nozzle. The spray nozzle is located on the one end of the elongated handle member adjacent to the squeegee member. The squeegee member extends at an oblique angle upward and downward from the elongated handle member. The spray apparatus is located above the squeegee member. The reservoir is attached to the other end of the elongated handle member opposite the one end of the handle member. The manually actuate pump apparatus is located on the other end of the elongated handle member and including a digitally depressible trigger member.

U.S. Pat. No. 5,186,392 to Pieshek discloses an extendable liquid-applying device of the type used for cleaning interior walls and ceilings. The device includes first and second tubular members telescoped together and slidable relative to one another to extend and retract the device. One of the members has a proximal end. The other has a distal end and an attached angularly-oriented nozzle. A continuous length of coiled flexible hose extends within the members and connects to the nozzle member. That is, the hose extends unbroken along the lengths of the members, from the proximal end to the distal end, to provide discharge from the nozzle member regardless of the relative positions of the members. A separate base member plugs into the proximal end and has a valve for controlling liquid flow. With a nozzle attached thereto, the base member can be used alone for "close-in " cleaning.

U.S. Pat. No. 5,165,811 to MacLeod relates to a cleaning apparatus having an elongate handle, which mounts a support plate having a head member thereon. The head member includes aa removably mounted sponge head securable to a forward face of the head member. A flexible polymeric arcuate plate is removable mounted to a rear face of the head member. The invention includes the handle formed with a refillable reservoir, wherein the handle is deformable to effect pressurizing of the reservoir and to effect directing of fluid through a supply conduit to a further supply conduit, Thereafter, it directs cleaning fluid to the sponge through a series of valve plugs directed through the further supply conduit.

U.S. Pat. No. 4,776,716 to Huang relates to a foldable multipurpose cleaning device which includes a fluid-receiving receptacle member detachably connected to a cleaning head assembly. The receptacle member includes a plunger and dispensing means for the fluid. The cleaning head assembly includes and elongated scraper of squeegee and an brush or sponge borne on a carriage member. There is also an intermediate coupling member projecting from the carriage member and comprising a female housing member with a locking notch in its base, a slotted body member topped with a male head portion that has near its base a lug that is engageable with the notch on the female engaging member in a releasable gripping relationship when the carriage member is in a generally horizontal position for operation. The female housing member is pivotally attached to the male head portion by means of oppositely disposed pivot pin elements projecting from the male head portion into corresponding pivot slots in the female housing member for slip joint action therebetween.

U.S. Pat. No. 4,457,472 to Gerberth, Jr. describes and illustrates an extendable spray gun for hydraulically atomizing and spraying liquids such as paint. A paint spray device is detachable mounted to one end of a telescopically extendable pole while the operation thereof is remotely controlled or actuated by a triggering mechanism. The triggering mechanism is located at the other end of the pole where a handle is provided. The triggering mechanism includes means which automatically compensates for changes in pole length so that positive and direct actuation of the spray device by the triggering mechanism is unaffected.

U.S. Pat. No. 4,089,440 to Lee discloses a handle attachment snap, which engages over the top of an aerosol can. It includes a trigger adapted to depress a spray button. The device fits most sizes of cans and adaptor rings may be provided t ensure a firmer support for smaller cans. The handle attachment and associated aerosol can may be secured to and elevated on a pole or other elongated support. The handle attachment is capable for remote operation for spraying of trees, buildings, and the like. A partially rotatable shroud is provided which when in one position, enables the trigger to be operated in order to dispense the contents of the can through the spray nozzle and when in the other position, prevents the trigger from being depressed and also shrouds the nozzle if the can is improperly placed within the assembly.

U.S. Pat. No. 4,023,711 to Sena relates to a paint spray gun which is locked into a receptacle at the free end of a tubular arm pivoted a t one end of an elongated tubular stock. The spray gun trigger is engaged by an operating finger, spring-biased toward the "off" position. The finger is operated by means of a sheathed, flexible cable through and operating lever mounted a the end of the stock farthest from spray gun receptacle. The relative angular position of the receptacle-bearing arm and the stock are adjustable. A quick-release receptacle is provided to permit the removal and reassembly of the spray gun to the extension arm with facility.

U.S. Pat. No. 3,658,432 to Lanusse describes and illustrates a spreader for applying make-up, paint, or like fluid product. It includes a detachable container for the product, which is secured to a body. The body includes a source of electrical energy for feeding an electrical motor driving a pump, a handle carrying a control means for the motor, and a working head enclosing partially a freely rotatable roller provided with an absorbent lining which receives the product from an internally disposed sprinkling ramp fed by the pump.

U.S. Pat. No. 3,377,123 to Leeson relates to a cleaning device, which includes a telescoping hollow handle through which water is fed from a valve controlled hose connection at one end of the handle to a discharge nozzle located at the other end. The nozzle is mounted on a retaining plate for a cleaning pad and water is discharged from the nozzle generally parallel with the cleaning pad and laterally thereof so that a detergent may be applied to the pad without being rinsed off by the water discharged from the nozzle. The retaining plate is pivotally mounted so that the pad and nozzle and be adjusted to lie generally parallel with the axis of the handle or ant an angle thereto. A squeegee blade is also pivotally mounted on the retaining plate.

U.S. Pat. No. 1,783,506 discloses a glass cleaning device, which includes a hollow handle functioning as a container for a limited supply of water, and a force-feed hand manipulated pump carried thereby for forcing the water into a distributing and spraying head. The distributing and spraying head is carried by the upper end of the handle, whereby allowing for water to be sprayed against a window at the users discretion, and to be subsequently scrubbed or wiped therefrom by a rubber squeegee strip mounted on the head.

U.S. Pat. No. 622,809 to Keyser relates to a window cleaner. It includes a handle upon which is surmounted a metallic sphere or hollow ball, above which is secured a horizontally disposed cylindrical water-tank, The water tank communicates with a hollow sphere by means of a spout projecting from an underside of the tank into the ball. The device further includes a hollow rubber ball mounted upon the spout of the tank within the metallic ball, a hollow rubber ball mounted upon the spout of the tank within the metallic ball, a rubber tube leading from the interior of the metallic ball through the spout and tank and ending in a nozzle at the upper end, means for compressing the rubber ball to discharge water from the nozzle, means for filling the tank, a holder for a rubber drier, and a holder for a drying cloth or chamois skin also attached to the tank.

Notwithstanding the aforesaid prior art, the present invention system is neither taught nor rendered obvious thereby.

SUMMARY OF THE INVENTION

The present invention is a squeegee with squeegee handle and remote spraying device, which includes a squeegee handle having an enclosed container for holding liquid, a sprayer head, which is in connection with a squeegee section, and a surface extending in a lengthwise direction. The enclosed container has a threaded neck.

The sprayer head has a threaded cap adapted for engaging the threaded neck, as well as a dispensing means for dispensing the liquid. The dispensing means includes a trigger being in connection with a conduit, a plurality of nozzles extending from a first wiping support attached to a side of a squeegee blade, and pressure inducing means for inducing a pressure change in the conduit so as to draw spraying agent into the conduit and out of the plurality of nozzles. The first wiping support includes a first wiping means in cooperation with liquid from the plurality of nozzles. The first wiping means may be cloth, sponge, electrostatic cloth and the like. The pressure inducing means may cause either an increase or a decrease in pneumatic pressure. The conduit extends through the threaded cap and into the enclosed container on one end and through the plurality of nozzles on the other end.

There is also a squeegee section having the squeegee blade attached to a top of the squeegee handle and being nearly perpendicular to the surface of the enclosed container extending in a lengthwise direction. The first wiping support being attached to a center portion of the squeegee blade is nearly parallel to the surface of the enclosed container extending in a lengthwise direction. In the embodiments, the squeegee blade may be aligned any where in relationship to the nozzles; i.e., above, at, or below.

In some embodiments, the device further includes an extended handle being connected to the squeegee handle and extending downwardly therefrom. In some embodiments, the extended handle is integrally formed as one surface. In other embodiments, there are extending sections which allow for an infinite extension in length of the extended handle. The size and shape of the extended handle may include, but is not limited to, elongated circular, stocky circular, elongated polygonal, stocky polygonal, and the like.

There is also an optional second wiping support connected to a same side of the device as one of the squeegee blade side and the first wiping support side. The second wiping support includes tilting mechanism for tilting the second wiping support away from the first wiping support in order to avoid rewetting by the first wiping support. The squeegee blade extends beyond the second wiping support when the second wiping support is in an untilted position. The second wiping support includes a clamp for holding second wiping means. The second wiping means may be cloth, sponge, electrostatic cloth, and the like.

In preferred embodiments, the extended handle further includes a plurality of sections in which each section includes extending means for extending each of the sections so that the extended handle is extended in length. The extending means may include, but are not limited to, telescoping attached sections, screw-in sections, clamped sections, hook and aperture sections, and the like.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
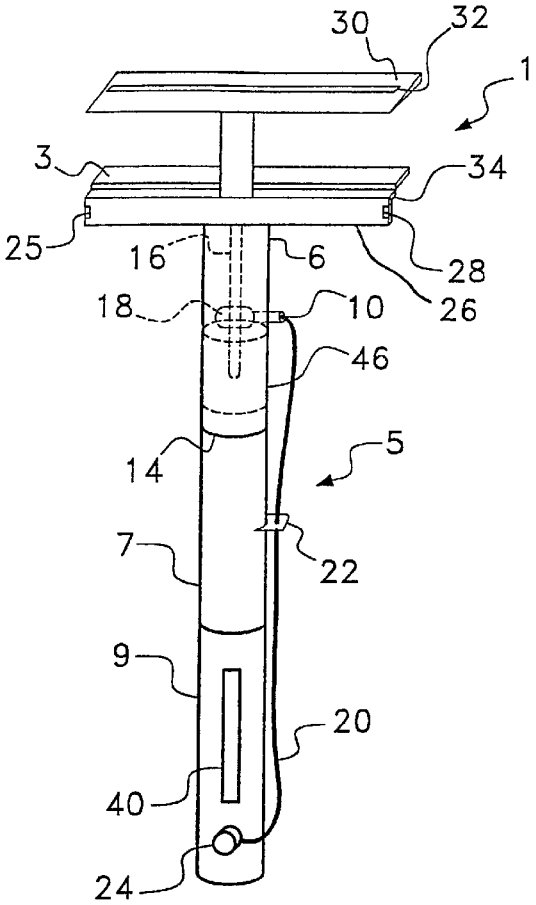
FIG. 1 shows a perspective partially transparent view of a present invention spray squeegee having automatic recipient surface-wetting mechanism with extension arid remote triggering system device having an extended handle formed from a plurality of telescoping sections, with at least one telescoping section being extended.

The present invention is a squeegee with squeegee handle and remote spraying device, which includes a squeegee handle having an enclosed container for holding liquid, a sprayer head, which is in connection with a squeegee section, and a surface extending in a lengthwise direction. The enclosed container has a threaded neck.

The sprayer head has a threaded cap adapted for engaging the threaded neck, as well as a dispensing means for dispensing the liquid. The dispensing means includes a trigger being in connection with a conduit, a plurality of nozzles at an end of a first wiping support, and pressure inducing means for inducing a pressure change in the conduit so as to draw spraying agent into the conduit and out of the nozzle. The conduit extends through the threaded cap and into the enclosed container.

There is also a squeegee section having a squeegee blade attached to the squeegee handle and being nearly perpendicular to the surface of the enclosed container. The first wiping support is attached to an inner side of the squeegee blade and being nearly parallel to the surface of the enclosed container. The first wiping support includes a first wiping means and a clamp for connecting the first wiping means. The first wiping means is in cooperation with the nozzles, thus allowing the spray agent to be moved to the first wiping means. The first wiping means may be sponge, cloth, electrostatic material, and the like. The squeegee blade may be aligned any where in relationship to the nozzles; i.e., above, at, or below.

There is also an optional second wiping support connected to a same side of the device as one of the squeegee blade side and the first wiping support side. The second wiping support includes tilting mechanism for tilting the second wiping support away from the first wiping support in order to avoid rewetting by the first wiping support. The squeegee blade extends beyond the second wiping support when the second wiping support is in an untilted position. The second wiping support includes a clamp for holding wiping material. The wiping material may be cloth, sponge, electrostatic cloth, and the like.

In some embodiments, the device further includes an extended handle having a threaded section at one end. The extended handle is removably attached to the squeegee section through the threaded sections of the squeegee section and the extended handle. In some embodiments, the extended handle is integrally formed as one surface. In other embodiments, there are extending sections which allow for an infinite extension in length of the extended handle. The size and shape of the extended handle may include, but is not limited to, elongated circular, stocky circular, elongated polygonal, stocky polygonal, and the like.

In preferred embodiments, the extended handle further includes a plurality of sections in which each section includes extending means for extending each of the sections so that the extended handle is extended in length. The extending means may include, but are not limited to, telescoping attached sections, screw-in sections, clamped sections, hook and aperture sections, and the like.

As used hereinafter below, a user's reaching distance is defined to be the distance achieved by an extension of one's arm with the length of the squeegee handle added to it. An extended reaching distance is defined to be a user's reaching distance plus the sum of the length of each extended handle section.

Figure 2:
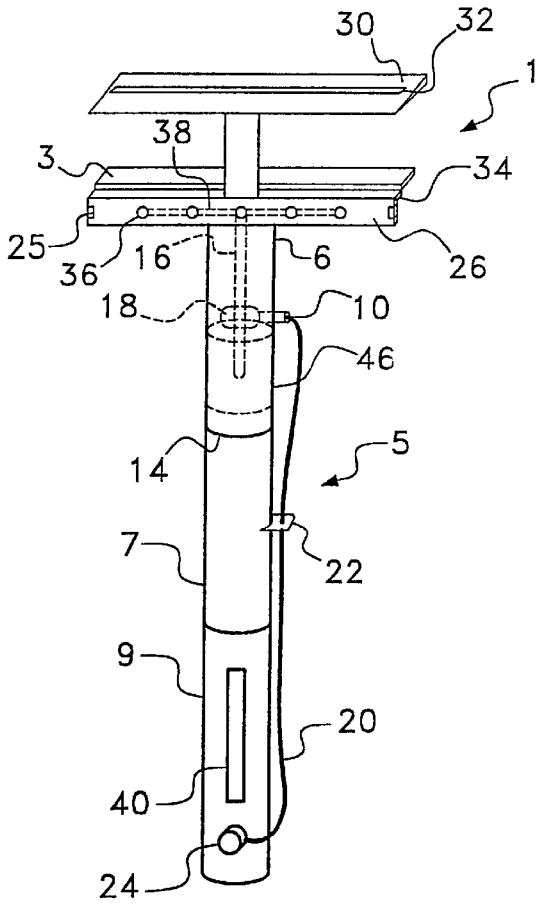
FIG. 2 shows a perspective partially transparent view of a present invention spray squeegee having automatic recipient surface-wetting mechanism with extension and remote triggering system device having an extended handle formed from a plurality of telescoping sections, with at least one telescoping section being extended and showing an inner view of the recipient surface wetting mechanism.
Figure 3:
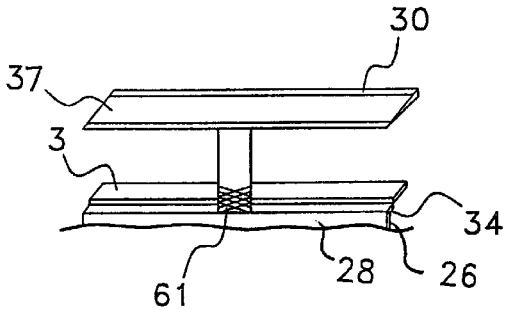
FIG. 3 shows a partial perspective view of the present invention device shown in FIG. 1 and having recipient surface-wetting mechanism and wiping means, both being attached to a squeegee blade.

Referring now to FIG. 1, FIG. 2 and FIG. 3, there is shown a present invention spray squeegee having automatic recipient surface-wetting mechanism with extension and remote triggering system device 1 having an extended handle 5 formed from a plurality of telescoping sections 7, 9 FIG. 1 shows first wiping means 28 connected to a first wiping support 26 through first wiping support means 25, while FIG. 2 shows the first wiping support 26 without the first wiping means 28 connected. FIG. 3 shows the details of the first wiping support 26, and a second wiping support 30, both being attached to a squeegee blade support 34.

As shown, the device includes an extended handle 5 on a lower section and a squeegee handle 6 on an upper section. As shown, the extended handle 5 includes the plurality of extendable sections 7, 9. The plurality of telescoping sections 7, 9 are located within each other when the extended handle 5 is unextended. When the extended handle 5 is extended, a user slides a portion nearest the squeegee handle 6 downwardly along a telescoping means and extends the extended handle 5 to a maximum length of a telescoping section 7. Although this embodiment shows telescoping attached sections, other conventional means known in the art for attaching and extending sections are within the scope of this invention. Such means include, but are not limited to, screw-in sections, clamped sections, hook and corresponding aperture sections, and the like.

A squeegee blade support section 34 is in connection with a top of the squeegee handle 6. The squeegee section 34 has the first wiping support 26 attached to a side, which includes a conduit 16 extending from an enclosed container 46 and through a plurality of nozzles 36, 38 located on the first wiping support 26. Note that the first wiping support 26 and the squeegee blade 3 are on opposite sides of the device 1.

Together, the squeegee handle 6 and the extended handle 5 or pole make up the majority of the vertical length in the apparatus. The squeegee handle 6 holds a reservoir 46 that contain a spraying agent, i.e., water, alcohol, glycol, and the like. The squeegee handle 6 and the extended handle 5 are joined together by threads 14, in this embodiment, but may be any similar connecting means known in the art. The extended handle 5 includes attaching means 40, which stores various attachments when they are not in use on the squeegee blade support section 34. Such attachments include, but are not limited to, a blade, a clamp, a sponge, wiping means, an electrostatic dust remover such as SWIFTER®, and the like.

The plurality of nozzles of the first wiping support 26 is in connection with a pump 18. A squeegee blade 3 is at or above the level of the plurality of nozzles, as shown in FIG.

Figure 4:
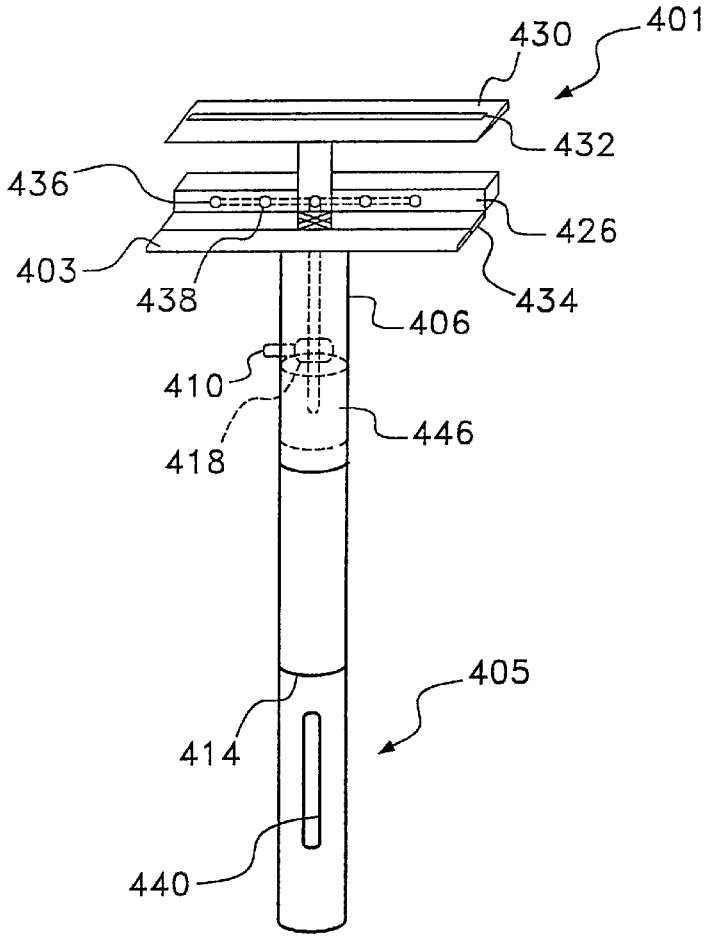
FIG. 4 shows a rear partially transparent perspective view of the present invention device shown in FIG. 1.

1. Alternatively, however, the blade 3 may be constructed at or below a top of the squeegee handle 6 so that the plurality of nozzles may be above the blade 3, thereby allowing the spray to be delivered to the desired surface for wiping, cleaning and the like, without hitting the blade 3. FIG. 4, described hereinafter below, shows in operation alignment of at or below relative placement of a blade 403 to the nozzles.

The squeegee handle 6 further includes a source of spraying agent, e.g., the enclosed container, in this case, bottle 46 or some other container, a pump means for moving the spraying agent by a pressure inducing means, and preferably a conduit 16, which provides a path for the spraying agent from a source to the plurality of nozzles, which is in close connection with the first wiping means 28. The pressure inducing means may induce either an increase in pneumatic pressure or a decrease in pneumatic pressure to draw spraying agent into the conduit 16 and out of the plurality of nozzles.

A spraying system, which includes the enclosed container 46, the conduit 16 and the plurality of nozzles, may be any state of the art means. Typical systems found in connection with aerosol sprays, squirt guns or bicycle pumps are suitable systems whose basic construction may be adapted in order to fit into the system described herein. Typically, such systems rely on an enclosed container 46 or reservoir that is in connection with a pump 18. The pump 18 is activated by a trigger 10 that it then delivers air to the spraying agent in the container 46, so that the spraying agent is forced through the conduit 16 and out the plurality of nozzles of the first wiping means 28.

In this embodiment, the pumping system and a container 46 may be mounted in the extended handle 5 and is in close connection to a squeegee blade support section 34 near an end of the extended handle 5. The trigger 10 is close to the pump 18 itself and thus the trigger 10 would be some distance above a user who may be several feet below the recipient surface, when the extended handle 5 is extended. The trigger 10 is in connection with a line 20 or some similar extending member that extends downward from the squeegee section 34 and toward the ground or other surface. Eyelets 22 may be used on the extended handle so that the line 20 may be threaded through them and extended to the ground or other surface. Thus, the user can activate the trigger 10 from a distance below the trigger 10 by manipulating the line through pulling, moving, rotating, and the like.

The line 20 may be wound at the bottom of the telescope extended handle 5 in a retractable spool 24 that takes up slack in the line 20. The spool 24 would be constructed on an outermost telescoping section 9 of the extended handle 5. Thus, the line 20 will be let out as the extended handle 5 is extended and taken up when the extended handle 5 is retracted or shortened, by moving an appropriate telescoping sections upwardly. Moreover, by remotely activating the trigger 10, an extended reaching distance is attained, which is at least as great as an expanse of a user's reaching distance by using limbs and the like.

The line 20 may also be attached to the trigger 10 without the use of the spool 24. Eyelets 22 may optionally be used for controlling the movements of the line 20, but are not necessary for the scope of the present invention. Alternatively, the line could be attached to the trigger and would then dangle freely. Moreover, the trigger may-have an eyelet to attach the pull line wherein the pull line has a metal clip on an end that will clip into the eyelet on the trigger. Of course, the clip at the end of the pull line will need to be smaller that the eyelets on the side of the spray squeegee and extended handle sections, so that the clip will pass through the eyelets to reach and clip onto the trigger eyelet.

As shown in FIG. 3, a second wiping support 30 is attached to the handle through the squeegee blade support 34. It has a tiltable base 61 inserted into the squeegee blade support 34 in which the second wiping support 30 may be moved relatively forwardly so as not to rewet the surface with the first wiping means 28. As shown, an edge of the first wiping support 26 extends beyond the edge of the second wiping support 30. Thus, there will not be interference from the second wiping support 30 when a user is moving the first wiping support 26. There is a clamp 32 for connecting a second wiping means 37 to the second wiping support 30. The second wiping means 37 may be sponge, cloth or electrostatic cloth. The second wiping support 30 is connected to a same side of said device as one of the squeegee blade 3 side and the first wiping support 26 side.

Referring now to FIG. 4, there is shown an alternative embodiment of a present invention spray squeegee having automatic recipient surface-wetting mechanism with extension and remote triggering system 401. Similar parts as to those numbered in FIG. 1 are similarly numbered but beginning with '400'.

The device 401 includes a second wiping support 430 located on the same side of the device 401 as the squeegee blade 403. Again, the second wiping support 430 is tiltable so that the squeegee blade 403 will not interfere with the operation of the second wiping support 430.

Figure 5:
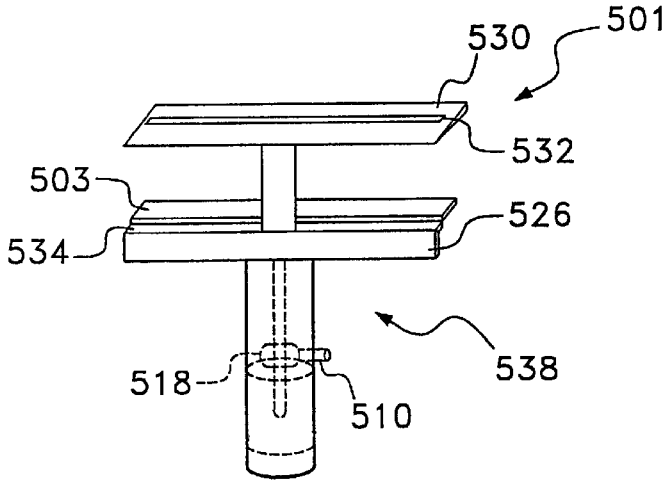
FIG. 5 shows a perspective partially transparent view of a present invention spray squeegee having automatic recipient surface-wetting mechanism with extension and remote triggering system device having an integral handle.

FIG. 5 shows a perspective partially transparent view of a present invention spray squeegee having automatic recipient surface-wetting mechanism with extension and remote triggering system device 501 having an integral handle 538. In this embodiment, similar parts as those shown in FIG. 1 are similarly numbered but beginning with '500'.

Obviously, numerous modifications and variations of the present invention are possible in light of the above teachings. For example, the pump may be activated by any pump delivery system means. It is, therefore, understood that within the scope of the appended claims, the invention may be practiced otherwise than as specifically described herein.

What is claimed is:

1. A spray squeegee with squeegee handle and remote spraying device which comprises:

(a) said squeegee handle having an enclosed container for holding spraying agent, said squeegee handle being connected to an extended handle on a lower section, said squeegee handle having a squeegee section, said squeegee section having a surface extending in a lengthwise direction, said squeegee handle having a sprayer head connected to said enclosed container and located at said squeegee section;

(b) said sprayer head having a threaded cap adapted for engaging said enclosed container, and a dispensing means for dispensing the spraying agent, said dispensing means including a trigger in connection with a conduit, a plurality of nozzles extending from a first wiping support attached to a side of a squeegee blade and being in connection with said conduit, said first wiping support having a first wiping support means attached thereto, and pressure inducing means for inducing an increase in pneumatic pressure in said conduit so as to draw spraying agent into said conduit and to move said spraying agent out of each of said plurality of nozzles, said conduit extending through said threaded cap and into said enclosed container on one end and through said nozzles on another end;

(c) said squeegee section being in connection with a top of said squeegee handle and including said squeegee blade and said first wiping support, said first wiping support being attached to said squeegee blade and being nearly parallel to said surface extending in said lengthwise direction of said squeegee handle wherein said squeegee blade is one of aligned at said nozzles and aligned below said nozzles such that when said trigger is moved, said spraying agent flows from said conduit and out through said nozzles onto said first wiping support means connected to said first wiping support; and, (d) a second wiping support connected to a same side of said device as one of said squeegee blade side and said first wiping support side.

2. The spray squeegee with squeegee handle and remote spraying device of claim 1, wherein said extended handle extends downwardly from said squeegee handle.

3. The spray squeegee with squeegee handle and remote spraying device of claim 2 wherein said extended handle is integrally formed as one surface.

4. The spray squeegee with squeegee handle and remote spraying device of claim 1 wherein said first wiping support means includes a first wiping means selected from the group consisting of sponge, cloth, and electrostatic cloth.

5. The spray squeegee of claim 1 wherein said second wiping support includes tilting means for tilting said second wiping support away from said first wiping support in order to avoid rewetting by said first wiping support means.

6. The spray squeegee of claim 5 wherein said squeegee blade extends beyond said second wiping support when said second wiping support is in an untilted position.

7. The spray squeegee of claim 6 wherein said second wiping support includes a second wiping means having a clamp for holding said second wiping means.

8. The spray squeegee of claim 7 wherein said second wiping means is selected from the group consisting of sponge, cloth, and electrostatic cloth.

9. A spray squeegee with squeegee handle and remote spraying device which comprises:

(a) said squeegee handle having an enclosed container for holding spraying agent, said squeegee handle being connected to an extended handle on a lower section, said squeegee handle having a squeegee section, said squeegee section having a surface extending in a lengthwise direction, said squeegee handle having a sprayer head connected to said enclosed container and located at said squeegee section;

(b) said sprayer head having a threaded cap adapted for engaging said enclosed container and a dispensing means for dispensing the spraying agent, said dispensing means including a trigger in connection with a conduit, a plurality of nozzles extending from a first wiping support attached to a side of a squeegee blade and being in connection with said conduit, said first wiping support having a first wiping support means attached thereto, and pressure inducing means for inducing an increase in pneumatic pressure in said conduit so as to draw spraying agent into said conduit and to move said spraying agent out of each of said plurality of nozzles, said conduit extending through said threaded cap and into said enclosed container on one end and through said nozzles on another end;

(c) said squeegee section being in connection with a top of said squeegee handle and including said squeegee blade and said first wiping support, said first wiping support being attached to said squeegee blade and being nearly parallel to said surface extending in said lengthwise direction of said squeegee handle wherein said squeegee blade is one of aligned at said nozzles and aligned above said nozzles such that when said trigger is moved, said spraying agent flows from said conduit and out through said nozzles onto said first wiping support means connected to said first wiping support; and, (d) a second wiping support connected to a same side of said device as one of said squeegee blade side and said first wiping support side.

10. The spray squeegee of claim 9 wherein said first wiping support is located on an opposite side of said squeegee blade.

11. The spray squeegee of claim 10 wherein said first wiping support means includes a first wiping means selected from the group consisting of sponge, cloth, and electrostatic cloth.

12. The spray squeegee of claim 11 wherein said second wiping support includes tilting means for tilting said second wiping support away from said first wiping support in order to avoid rewetting by said first wiping means.

13. A spray squeegee which comprises:

(a) said squeegee handle having an enclosed container for holding spraying agent, said squeegee handle being connected to an extended handle on a lower section, said squeegee handle having a squeegee section, said squeegee section having a surface extending in a lengthwise direction, said squeegee handle having a sprayer head connected to said enclosed container and located at said squeegee section;

(b) said sprayer head having a threaded cap adapted for engaging said enclosed container and a dispensing means for dispensing the spraying agent, said dispensing means including a trigger in connection with a conduit, a plurality of nozzles extending from a first wiping support attached to a side of a squeegee blade and being in connection with said conduit, said first wiping support having a first wiping support means attached thereto, and pressure inducing means for inducing an increase in pneumatic pressure in said conduit so as to draw spraying agent into said conduit and to move said spraying agent out of each of said plurality of nozzles, said conduit extending through said threaded cap and into said enclosed container on one end and through said nozzles on another end;

(c) said squeegee section being in connection with a top of said squeegee handle and including said squeegee blade and said first wiping support, said first wiping support being attached to said squeegee blade and being nearly parallel to said surface extending in said lengthwise direction of said squeegee handle wherein said squeegee blade is one of aligned at said nozzles and aligned above said nozzles such that when said trigger is moved, said spraying agent flows from said conduit and out through said nozzles onto said first wiping support means connected to said first wiping support;

(d) an extended handle being connected to said squeegee handle and extending downwardly therefrom wherein said extended handle includes a plurality of telescoping sections such that said extended handle may be extended in length; and, (e) a second wiping support connected to a same side of said device as one of said squeegee blade side and said first wiping support side.

14. The spray squeegee of claim 13 wherein said first wiping support means includes a first wiping means selected from the group consisting of sponge, cloth, and electrostatic cloth.

15. The spray squeegee of claim 14 wherein said second wiping support includes tilting means for tilting said second wiping support away from said first wiping support in order to avoid rewetting by said first wiping support.

* * * * *